US005469619A

United States Patent [19]

Renck

[11] Patent Number: 5,469,619

[45] Date of Patent: Nov. 28, 1995

[54] TUBULAR CORE ASSEMBLY HAVING INSIDE-DIAMETER REDUCING END MEMBERS SECURED BY MECHANICAL INTERLOCKING MEMBER

[75] Inventor: Lawrence E. Renck, Hartsville, S.C.

[73] Assignee: Sonoco Products Company, Hartsville, S.C.

[21] Appl. No.: 230,606

[22] Filed: Apr. 21, 1994

Related U.S. Application Data

[62] Division of Ser. No. 49,711, Apr. 20, 1993, Pat. No. 5,340,050.

[51] Int. Cl.[6] ..... B31D 5/00

[52] U.S. Cl. ..... 29/895.2; 242/609.1; 242/613.5; 492/47; 493/308

[58] Field of Search ..... 29/895, 895.1, 29/895.2, 895.3, 895.23; 242/609.1, 609.2, 609.3, 613.5; 492/47, 60; 225/47; 413/1, 2, 26; 493/308

[56] References Cited

U.S. PATENT DOCUMENTS

| | | | |
|---|---|---|---|
| 411,140 | 9/1889 | Farrington | 242/613.5 |
| 1,108,038 | 8/1914 | Warne | 492/47 |
| 1,118,860 | 11/1914 | Howarth . | |
| 1,137,470 | 4/1915 | Elixman . | |
| 1,881,911 | 10/1932 | Parker | 242/613.5 |
| 1,908,108 | 5/1933 | Boldman | 242/613.5 |
| 2,052,541 | 8/1936 | Roberts et al. . | |
| 2,076,870 | 4/1937 | Taylor . | |
| 3,204,763 | 9/1965 | Gustafson . | |
| 3,275,257 | 9/1966 | Cherniavskyj . | |
| 3,482,607 | 12/1969 | Villani et al. . | |
| 4,295,921 | 10/1981 | Bopst, III . | |
| 4,754,537 | 7/1988 | Lee | 492/47 |
| 4,874,139 | 10/1989 | Kewin . | |
| 4,875,636 | 10/1989 | Kewin . | |
| 5,236,141 | 8/1993 | Kewin . | |

FOREIGN PATENT DOCUMENTS

| | | |
|---|---|---|
| 785147 | 5/1968 | Canada . |
| 510398 | 10/1930 | Germany . |
| 1238302 | 4/1967 | Germany . |
| 888860 | 2/1962 | United Kingdom . |

*Primary Examiner*—Jack W. Lavinder
*Attorney, Agent, or Firm*—Bell, Seltzer, Park & Gibson

[57] ABSTRACT

A tubular core assembly for winding or unwinding sheet material, such as newsprint or Rotogravure Print, wherein the opposed ends of an elongate cylindrical core are provided with inside diameter-reducing annular core insert members. The inside diameter-reducing annular core insert members are secured by a mechanical interlocking member to a central core body formed by multiple wraps of a paperboard material. The mechanical interlocking member includes at least one radially interlocking member secured to and extending member and the annular core insert member. Because of the mechanical interlocking relationship between the inside diameter-reducing annular core insert members and the central core body member, the inside diameter-reducing annular core insert members are secured to the central core body member in positive locking relationship.

8 Claims, 2 Drawing Sheets

TUBULAR CORE ASSEMBLY HAVING INSIDE-DIAMETER REDUCING END MEMBERS SECURED BY MECHANICAL INTERLOCKING MEMBER

This application is a divisional of application Ser. No. 08/049,711, filed Apr. 20, 1993 now U.S. Pat. No. 5,340,050.

FIELD OF THE INVENTION

The invention relates to a tubular core of the type used for winding paper, such as newsprint, film and other sheet material. More specifically, the invention is directed to a tubular core assembly having mechanically interlocked core insert members for reducing the inside diameter of the ends of the tubular core.

BACKGROUND OF THE INVENTION

Tubes and cores are widely used in the film and paper industry for winding film and paper into roll form. These cores are usually made of paperboard and are formed by a spiral or convolute wrap process. Thus, one or more plies of paperboard are coated with adhesive and wrapped around a mandrel to seal each layer to the next in the structure. For lightweight uses, the tubes or cores are made of lightweight paperboard and may have only a few layers. However, for heavy duty uses, such as for winding and unwinding for newspaper and Rotogravure printing, the tubes are usually very long, for example up to about 10 ft. (3.08 m.) for U.S. Rotogravure printing and 10.5 ft. (3.22 m.), for European Rotogravure printing. In view of the large size, these tubes must be of very heavy or thick construction to be able to carry the weight of a large roll of paper.

In use on winding and unwinding equipment, the tubular cores are mounted on stub shafts or chucks of standard size. U-shaped metal end caps are typically inserted into the open ends of the tube to assist in more positive mounting of the paperboard cores on the chucks or stub shafts of the winding and unwinding equipment.

Many paperboard cores used in film and paper processes have a three-inch inside diameter. Similarly a substantial proportion of the commercially used printing and winding equipment has chucks and/or stub shafts designed to cooperate with three-inch inside diameter cores.

At times, printers and/or film and paper manufacturers prefer to use a larger tubular core on equipment designed for use with a core of smaller diameter in order to improve both vibration and dynamic strength performance. For example, many conventional cores have a six-inch inside diameter and it is clear that the use of a six-inch inside diameter core with equipment designed to support a core having a three-inch inside diameter can significantly impact vibration during the winding and unwinding process.

U.S. Pat. No. 4,875,636 to Kewin discloses a non-returnable newsprint carrier system in which the newsprint cylindrical core can be used without the need for metal end caps. The inside surfaces of the opposite end portions of the tubular core have substantially the same non-cylindrical configuration, profile and dimensions as the outside surfaces of the reel stub shafts of an offset printing press so that the tubular core and newsprint stub shaft will have a full profile fit in surface-to-surface contact over substantially the entire surface of the reel stub shafts inserted within the core during use thereof.

U.S. Pat. No. 4,874,139 to Kewin discloses tubular core assemblies which include an annular core insert member which may be made of a cellulosic material, permanently bonded to the inside end of a tubular paperboard core. The use of such an interior annular core insert can allow for the use of a smaller wall thickness paperboard tube. In practice, there is a problem with the annular core insert because it is fastened to the interior of the inside tube by an adhesive. The exterior of the core insert must have a tight fit with the interior of the core, inside the tube, to eliminate vibration and wobble in high speed winding and to try to keep the insert from breaking loose during sudden acceleration or deceleration of the unwind machine. Because of the relatively close tolerance fit between the annular core insert and the inside of the core, the adhesive, intended to bond the annular core insert to the core, is typically wiped out of the minimal space between the insert and the core during the axial insertion process. Moreover, unless the exterior surface of the annular core insert and the interior surface of the tube, are perfectly symmetrical and circular, gaps can be left between the two surfaces where no bonding occurs. Thus, in practice, the annular core inserts are seldom adhered securely to the tube and very seldom survive the winding operation, much less the unwinding operation.

The elimination of metal end caps for the mounting of cores on winding and unwinding equipment would be highly desirable. However, in practice the proposed systems of the prior art include various disadvantages as discussed above, including the poor bonding between interior annular core inserts and the ends of the tubular core and/or the need to reduce the diameter of inside portions of the tubular core in order to provide a tube with an inside surface having a profile matching the exterior profile of the reel stub shafts of winding and unwinding equipment. Moreover, there is no practical solution provided in the art for the recurring needs and desires of manufacturers to employ large diameter cores on equipment designed for use with smaller diameter cores.

SUMMARY OF THE INVENTION

According to the invention, a tubular core assembly includes a central paperboard core body having mechanically interlocked annular core insert members secured to each of its opposed ends for reducing the inside diameter of the ends. The inside diameter-reducing annular core insert members are secured to the inside periphery of the central core body member in positive axial locking relation by mechanical interlocking means. Because the inside diameter-reducing annular core insert members are positively engaged with the central core body member, the invention provides a practical and readily available means for reducing the inside diameter of the ends of large cylindrical cores while preserving and/or enhancing the integrity of the large cylindrical core so that the large cylindrical cores can readily be used with winding and unwinding equipment designed for use with smaller cores. In addition, the inside surfaces of the annular core insert members can be configured and profiled to match the outside dimensions of conventional stub shafts or chucks of conventional winding and unwinding equipment.

The tubular core assembly of the invention includes an elongate hollow center cylindrical core body having a bodywall which is preferably formed by multiple wraps of a paperboard material and having opposed ends, a predetermined outside diameter, and a predetermined inside diameter. Annular core insert members having at least a portion of their outside diameter, substantially the same as the inside diameter of the central core body, are attached to the inside periphery of each of the opposed ends of the central core body member in co-axial relationship therewith by a mechanical interlocking member. The mechanical interlocking member comprises at least one radially interlocking member secured to and extending radially into and at least partially through the central core member and the annular core insert member. The mechanical interlocking member provides for positive radial engagement between the inside diameter-reducing annular insert members and the central core body so that rotational motion applied to the annular insert members is positively transferred to the central core body and so that axially inward force applied to annular insert members is more positively transferred to the central core body with the result that the insert members have improved rotational and axial load capabilities. In addition when either or both of the annular core insert or the central core body are formed of a layered material, the mechanical interlocking member can also improve the integrity of the layered structure. Preferably at least two radially interlocking members are provided in each of the opposed ends of the central core body member for mechanically interlocking of the annular core insert member in each of the ends.

The inside diameter-reducing annular core insert members are readily formed from various cellulosic-based and/or polymer-based composite materials including wood particles or chips, wood pulp, paperboard, and/or liquid or solid polymers, preferably by conventional molding operations. The radially interlocking members can be preferably provided as cylindrical shaped members, e.g. pins, formed from various cellulosic and/or polymer based composite materials. In one advantageous embodiment of the invention the radially interlocking members are cylindrically shaped hollow members formed by multiple wraps of the paperboard material.

The tubular core assemblies of the invention can be used without the need for metal end caps or inserts. The inside diameter-reducing annular core insert members additionally strengthen the ends of the tubular core assembly by increasing the wall thickness of the core assembly ends. The inside annular surfaces of the inside diameter-reducing end members can be provided with shapes and profiles matching the exterior profiles of conventional chucks and/or reel stub shafts of winding and unwinding equipment so that such chucks and/or reel stub shafts can be inserted into the core assemblies of the invention in surface-to-surface contact with the inside surface of the core assembly as disclosed in U.S. Pat. No. 4,875,636 to Kewin, which is hereby incorporated by reference. The tubular core assemblies of the invention can be used with conventional core plugs during shipping of empty cores and/or fully wound rolls of paper and the like.

BRIEF DESCRIPTION OF THE DRAWINGS

In the drawings which form a portion of the original disclosure of the invention.

DESCRIPTION OF THE PREFERRED EMBODIMENT

In the following detailed description, exemplary preferred embodiments of the invention are described to enable practice of the invention. It will be apparent that the terms used in describing the invention are used for the purpose of description and not for the purpose of limiting the invention to the preferred embodiments. It will also be apparent that the invention is susceptible to numerous variations and modifications as will become apparent from a consideration of the invention as shown in the attached drawings and described herein.

Figure 1:
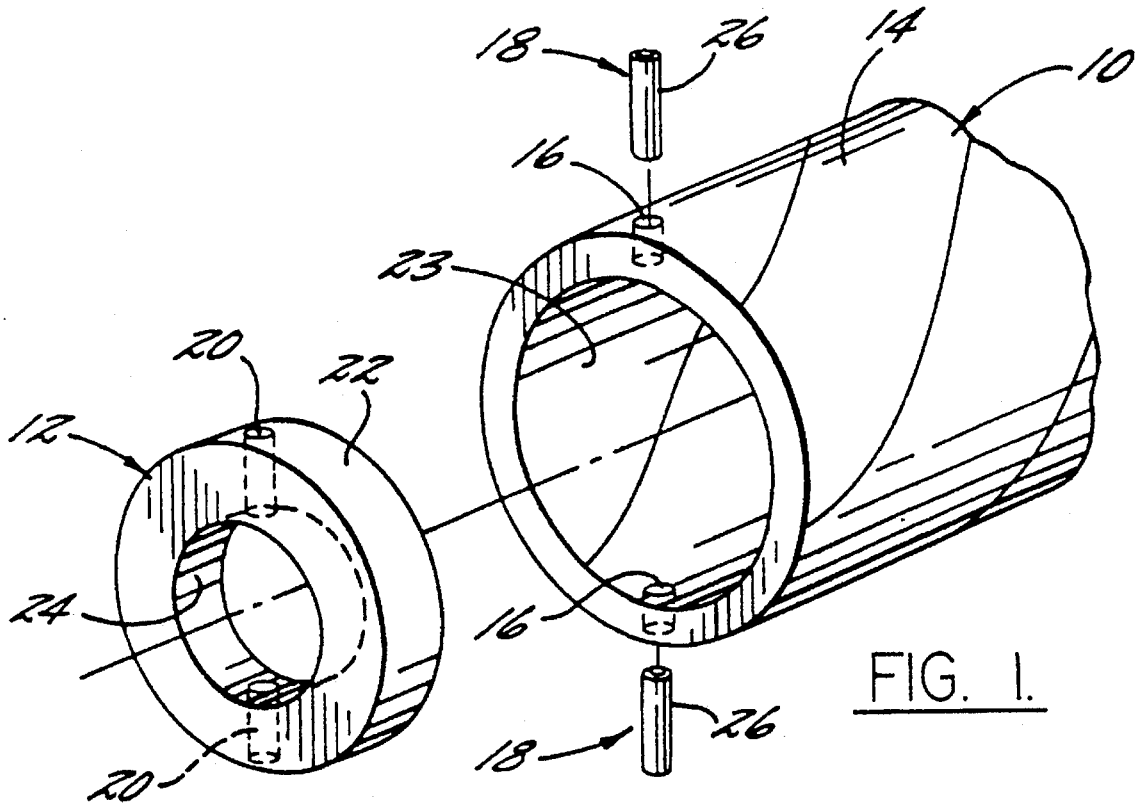
FIG. 1 is an exploded perspective view of one end portion of one preferred tubular core assembly of the invention, the other end being identical.

FIG. 1 illustrates an exploded perspective view of one end of a tubular core assembly of the invention. The opposed end of the tubular core assembly (not shown) is identical to the end shown in FIG. 1 as will be apparent. The tubular core assembly includes a central core body member 10 and an inside diameter-reducing annular core insert member 12. The central core body member 10 is defined by a cylindrical hollow body wall 14 which is preferably formed by multiple wraps of a paperboard material, although the invention is also advantageously employed with core bodies formed from other materials, such as plastics and the like.

As illustrated in FIG. 1, the bodywall 14 is a spiral wrapped tubular body formed by a conventional spiral wrapping process. Alternatively the bodywall can also be formed employing a conventional convolute wrapping process, or in the case of single layer tubes, a molding process, an extrusion process, or the like. In preferred embodiments, the bodywall 14 will include multiple paperboard layers. Both the spiral wrapping process and the convolute wrapping process are well known to those skilled in the art. In general, such processes involve the wrapping of one or more adhesive coated plys around a mandrel to provide a tubular body. The thickness of the bodywall and the density of the paperboard plys used in the wrapping process are chosen to provide the desired strength in the resultant bodywall. For example, where the core is intended for light-duty or light-weight uses, the paperboard plys can have a light density and/or light weight and the bodywall thickness can be relatively low, for example, in the range of from about 0.125 inches to about 0.25 inches. On the other hand, for heavy-duty uses, a thicker bodywall, for example in the range of between about 0.5 inches and about 0.875 inches is needed and typically a heavy and/or thick paperboard ply material is used.

Radially oriented annular bores 16 are provided in the annular ends of the bodywall 14 for receiving matching cylindrically shaped pin members 18.

Radially oriented annular bores 20 are also provided in the annular core insert members 12. The annular bores 20 in the annular core insert members 12 are positioned for radial alignment with annular bores 16 in the central core body 10.

Figure 2:
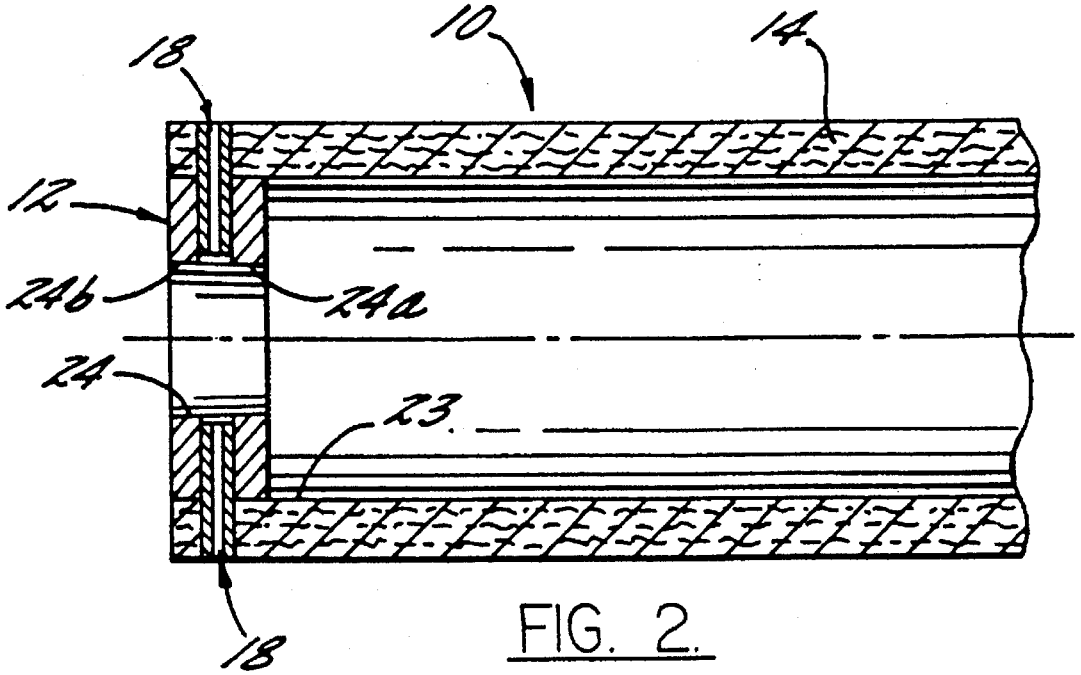
FIG. 2 is a cross-sectional side view of one end portion of a core assembly of the invention showing the inside diameter-reducing annular end member secured to one end of the central core body employing a preferred mechanical interlocking means.

FIG. 2 illustrates the fully assembled tubular core assembly wherein the radially interlocking pin members 18 are inserted through the bodywall 14 of the central core body member 10 and through the annular core insert member 12, thereby locking the annular core insert member 12 to the central core body member 10. Prior to the completion of the assembly as shown in FIG. 2, an adhesive material such as a latex or solvent-based and/or a thermosetting adhesive material may be applied to the outside surface 22 of the annular core insert member or to the inside peripheral surface 23 of the end of the central core body member, or to both such surfaces. Similarly, an adhesive material can be applied to the outer peripheral surface 26 of the radially interlocking pin members 18 and/or to the inside peripheral surfaces of bores 16 and 20 provided in the central core body member and the annular core insert members 12, respectively.

In one preferred embodiment of the invention, the radially interlocking pin members 18 are spiral or convolute wrapped paperboard cylindrical members. As indicated previously, the spiral wrapping and convolute wrapping process are well known. The use of radially interlocking pin members formed from multiple wraps of paperboard material can be particularly advantageous in that the final assembled structure shown in FIG. 2 can be formed completely from cellulosic-based materials. This improves the potential for recycling of the tubular core assembly of the invention following the end of its useful life.

It will be apparent that the sizes, shapes and arrangements of the radially interlocking members 18 and the bores 16 and 20 as illustrated in FIGS. 1 and 2 can be widely varied. Thus, the drawings illustrate the use of cylindrically shaped pairs of pin members which are employed at each end of the central core body member. However, the radially interlocking members 18 can have widely varying shapes including, for example, square or rectangular cross-sectional shapes, in which case the bores are advantageously shaped to match. Similarly, only a single radially interlocking pin member can be used at each end of the central core body member or more than two radially interlocking pin members can be used at each end.

In the arrangement illustrated in FIGS. 1 and 2 the two radially interlocking pin members 18 are arranged so that they are coaxially positioned with respect to each other. Such an arrangement is particularly advantageous in that all four of the bores 16 and 20 in the central core body member 10 and the annular insert member 12 can be formed in a single operation. Thus, the annular core insert member 12 can be inserted into the central core body member 10 and temporarily bonded thereto by means of a glue, or the like. Thereafter, using a conventional drill device, all four of the bores 16 and 20 can be drilled through the central core body member and the annular core insert member in a single operation. Forming the bores following temporary assembly of the central core body member and the annular core insert member ensures that the bores through each are properly aligned with each other.

The radially interlocking members 18 can be formed of materials other than paperboard as will be apparent to the skilled artisan. Thus, the radially interlocking members 18 can be formed from wooden dowels, from wood particles, from plastic materials, or the like by any of various well known molding and/or extrusion processes. Advantageously, the radially interlocking members 18 extend fully through the wall 14 of the central core body member and fully through the body wall of the annular core insert members. However, it will be apparent that the radially interlocking members can extend only partially through one or both of wall 14 of the central core body member and/or the annular core insert member.

The inside diameter reducing annular core insert members 12 are formed as indicated previously, by any of various well known processes, preferably by molding of cellulosic-based materials including wood pulp, wood particles and the like. Alternatively, the inside diameter-reducing annular core insert members can be formed by cutting desired lengths of paperboard tubular members to achieve the desired length for the annular insert members 12.

The central core body member 10 typically has an inside diameter of from a few inches, for example, three inches up to 6–7 inches or greater, preferably about 6 inches. The central core body member 10 generally has an extended length ranging from about 1 foot or more up to about 11 feet or greater, however, the benefits and advantages of the invention are most apparent when the entire tubular core assembly has a length of greater than about five feet, in view of the known problems as to vibration and dynamic strength performance with such elongated tubular core bodies as discussed previously.

The inside diameter-reducing annular core inert members 12 typically have a longitudinal length based on the desired end use of the tubular core assembly and preferably will have a length which is about the same or greater than the chuck or reel stub shaft intended to be inserted into the tubular core assembly. Typically, the length of the inside diameter-reducing core insert members 12 will range from about 1 inch to about 18 inches or more.

Figure 3:
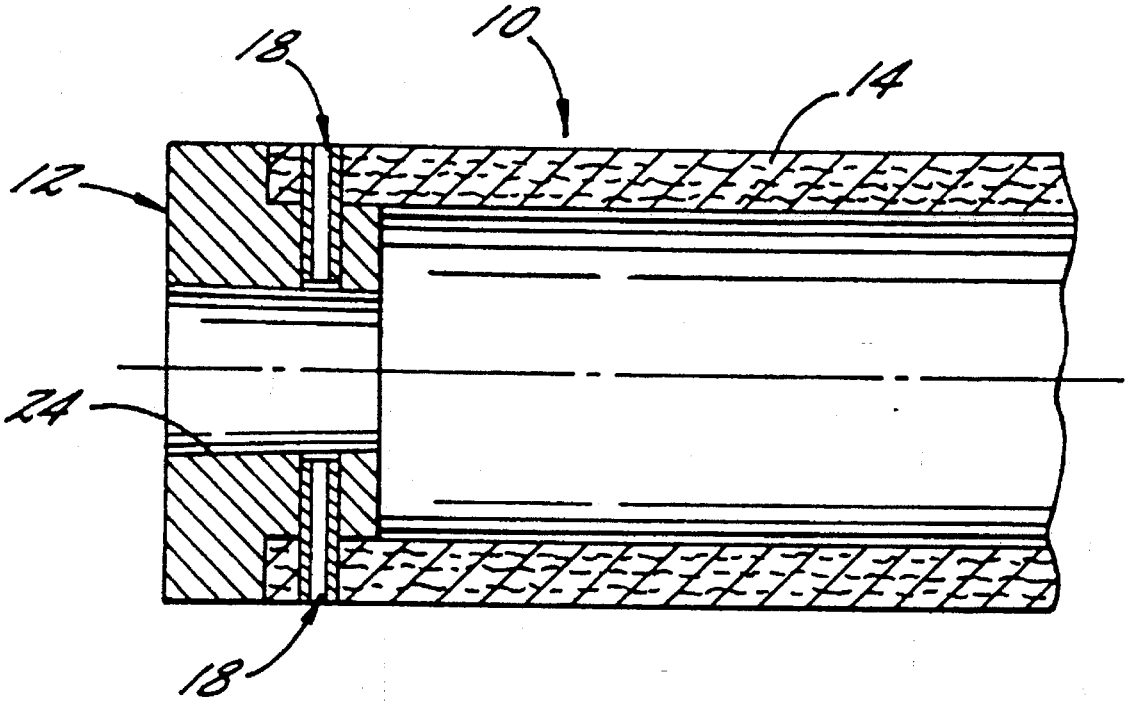
FIG. 3 is a cross-sectional side view of one end portion of a second preferred tubular core assembly of the invention wherein a portion of the outside diameter of the annular core insert member is substantially the same as the outside diameter of the central core body member.

In one embodiment of the invention (shown in FIG. 3), only a portion of each inside diameter-reducing core insert member is inserted into central core body member 10. For example, one end portion of the core insert member can have an outside diameter the same as the outside-diameter of the central core while the opposed end portion can have an outside diameter the same as the inside diameter of the central core body. Thus the exterior of the core insert can have a stepped longitudinal profile including an enlarged flange at one end thereof. The inside diameter of the core insert is advantageously substantially the same throughout its length, for example, three inches. The smaller diameter end is inserted into and joined to the inside periphery of the central core body, according to the invention. The larger outside diameter end or flange then defines both the exterior and interior of the end of the completed tubular core assembly.

As indicated previously, in a particularly preferred embodiment of the invention, the interior peripheral surface 24 of the inside diameter-reducing annular end members 12 can be profiled to match the exterior profile of a reel stub shaft used in winding and unwinding equipment as disclosed and illustrated in U.S. Pat. No. 4,875,636 which has been incorporated herein by reference. Thus, the interior surface of the inside diameter-reducing annular end members can include a first portion at a location **24*a* tapering radially outwardly in the axially outward direction, preferably at an angle of approximately 2° with respect to the longitudinal central axis of the tubular core assembly, and a second portion at a location 24*b* extending axially outwardly from the first portion 24*a* and tapering radially outwardly at a second predetermined angle, preferably approximately 33° with the respect to the central axis of the tubular core assembly. In addition, the inside surface 24** can include one or more grooves for receiving a spline or the like on the exterior of a reel stub shaft of conventional winding or unwinding equipment. Such preferred profiled interior surfaces are discussed and illustrated in greater detail in U.S. Pat. No. 4,875,636, which has previously been incorporated herein by reference.

The core assemblies of the invention can also be used with conventional metal inserts for receiving stub shafts or chucks; however, as discussed above, such metal inserts are not necessary in preferred embodiments of the invention. As indicated previously, a conventional core plug can advantageously be incorporated into the annular opening of the inside diameter-reducing annular end members during shipping and storage of the core assembly bodies of the invention in order to protect the ends thereof. Such core plugs are generally known to those skilled in the art and exemplary core plugs are also disclosed in the previously mentioned U.S. Pat. No. 4,875,636.

The invention has been described in considerable detail with reference to its preferred embodiments, however, it will be apparent that numerous variations and modifications can be made without departing from the spirit and scope of the invention as described in the foregoing detailed specification and defined in the appended claims.

That which is claimed is:

1. The process for forming a tubular core assembly for a roll of paper or other sheet material comprising:

providing an elongate hollow cylindrical central core body member comprising a bodywall having opposed ends, a predetermined outside diameter and a predetermined inside diameter;

providing inside diameter-reducing annular core insert members, each having at least a portion of its outside diameter substantially the same as the inside diameter of said central core body member and each being inserted into one or said opposed ends of said central core body;

forming at least one aligned bore in a single operation for each of said cylindrical core body ends and the annular core insert member inserted therein;

providing at least two radially interlocking members having substantially the same outside diameter as the inside diameter of said aligned bores and inserting and securing one of said radially interlocking members in each of said aligned bores in said cylindrical core body end and the associated core insert member so that each core insert member is secured to the inside periphery of the associated end of the central core body in positive interlocking relationship.

2. The process of claim 1 wherein said elongate hollow cylindrical central core body wall comprises multiple wraps of a paperboard material.

3. The process of claim 2 wherein said radially interlocking members are each formed of multiple wraps of paperboard material.

4. The process of claim 3 wherein said radially interlocking members are hollow, cylindrically shaped pin members.

5. The process of claim 1 wherein said step of forming aligned bores comprises drilling aligned bores through at least two portions of each of said opposed ends of said central core body and the associated annular core insert member.

6. The process of claim 1 wherein said central core body member comprises a bodywall formed of a plastic material.

7. The process of claim 1 wherein each of said inside diameter reducing annular core insert members are formed of a plastic material.

8. The process of claim 1 wherein said predetermined outside diameter of said central core body member is about six inches and wherein each of said diameter-reducing annular core insert members have an inside diameter of about three inches.

* * * * *

UNITED STATES PATENT AND TRADEMARK OFFICE

CERTIFICATE OF CORRECTION

PATENT NO. : 5,469,619

DATED : November 28, 1995

INVENTOR(S) : Lawrence E. Renck

It is certified that error appears in the above-identified patent and that said Letters Patent is hereby corrected as shown below:

ON THE COVER PAGE:

Column 1, References Cited, U.S. Patents, "Farrington" should be -- Farrington et al --; column 2, Abstract, line 10, after "extending" insert -- radially at least partially through the central core --.

Column 1, line 7, after "1993" insert a comma (,).

Signed and Sealed this

Fifth Day of March, 1996

*Attest:*

*Attesting Officer*

BRUCE LEHMAN

*Commissioner of Patents and Trademarks*